United States Patent [19]

Osborne

[11] Patent Number: 4,911,048

[45] Date of Patent: Mar. 27, 1990

[54] SAWMILL GAUGE

[76] Inventor: Alonzo G. Osborne, Seal Cove, White Bay, Newfoundland, Canada

[21] Appl. No.: 195,895

[22] Filed: May 19, 1988

[51] Int. Cl.[4] ..... B27B 27/08

[52] U.S. Cl. ..... 83/438; 83/468; 83/468.3; 269/303; 269/318

[58] Field of Search ..... 83/703, 705, 717, 718, 83/418, 419, 421, 438, 467 R, 468; 269/303, 318, 320

[56] References Cited

U.S. PATENT DOCUMENTS

| | | | |
|---|---|---|---|
| 808,889 | 1/1906 | Von Culin | 83/477.2 |
| 1,366,409 | 1/1921 | Munschauer | 269/318 |
| 1,789,125 | 1/1931 | Wilderson | 83/438 |
| 1,938,549 | 12/1933 | Tautz | 83/438 |
| 3,687,269 | 8/1972 | Fritz et al. | 83/703 |
| 4,702,137 | 10/1987 | Davidson et al. | 83/718 |

*Primary Examiner*—Hien H. Phan
*Attorney, Agent, or Firm*—Leon Gilden

[57] ABSTRACT

A sawmill gauge is set forth for use in combination in rough-cut push/pull type sawmill organizations. The gauge apparatus comprises a framework securable to an underlying support relative to a sawmill blade wherein the framework includes a plurality of parallel cooperating threaded tracks operative by means of a single external rotatable handle coextensive with one of the tracks including a carriage reciprocatably driven by the tracks including internal threads cooperative with external threads folded in the tracks. The carriage includes a guide beam reciprocatably adjustable relative to said carriage and pivotally securable thereto to provide angular adjustment of said guide relative to said sawmill. Angular adjustment of said guide is limited to fifteen degrees clockwise or counter-clockwise rotation of said guide including a fine adjustment set screw cooperative with a clamping arrangement for securing the guide in a predetermined angular orientation relative to the sawmill.

9 Claims, 5 Drawing Sheets

SAWMILL GAUGE

BACKGROUND OF THE INVENTION

1. Field of the Invention

The instant invention relates to sawmills and more particularly pertains to a new and improved sawmill gauge providing expedient and efficient positioning of a gauge relative to a sawmill blade.

2. Description of the Prior Art

The use of sawmill blades in the processing of timber is well known in the art and accordingly cooperating gauges therefore have been developed. The prior art unfortunately has been of a relatively complex and expansive organization to limit utility and acceptance of such gauges as an economic and efficient means of providing gauges for said sawmills. For example, U.S. Pat. No. 3,788,211 to Carter sets forth a sawmill guide utilizing a pivotal arm selectively securable at various angulations relative to a power saw blade wherein said arm is elevatable in a predetermined range for accommodation of boards of varying thicknesses. The Carter guide, while of interest relative to a saw blade, is of a relatively remote organization to that of the instant invention utilizing a reciprocating carriage stabilized by a plurality of threaded tracks conveniently operative by one of said tracks by a rotatable and manually manipulatable wheel.

U.S. Pat. No. 4,557,170 to Ingham sets forth a guide rail for guidance of work pieces therealong utilizing a single guide rail and an included measuring plate for adjustment of said carriage relative to a work piece. The apparatus is of interest relative to a generalized reciprocating carriage but fails to provide the multiple adjustment and stability of the instant invention.

U.S. Pat. No. 4,413,542 to Rempel utilizes a rectangular cutter base including a planar work piece supporting surface on a hinged frame with a cutter head mounted on a guide rod on the hinge frame including a stop associated with the frame. A plurality of parallel lateral hinge bars and an associated longitudinally extending handle interconnects the respective forward ends of the transversely mounted lateral hinge bars. The aforenoted cutter head includes a guide bar wherein a guide plate lies flush with the work piece supporting surface. The guide surface and work piece supporting surface are interrelated by a plurality of relatively complex and inter-operative structural organizations denoting typical prior art organizations of a complex characteristic opposed to those of the instant invention setting forth an efficient and cooperative relationship with the various structural elements related to the guide bar for efficient and responsive alignment of a work piece relative to a saw blade.

U.S. Pat. No. 4,224,854 to Malacheski wherein a cutting and scoring organization is provided with a guide plate wherein a track extending along the framework includes a carriage slidably movable therein with a tool holder carried by the carriage for movement along and located over a work piece including a tool depending on a tool holder for operative engagement with a work piece. The patent is of interest only relative to the simplistic organization of a carriage and guide surface, but fails to provide the stable guide surface of the instant invention.

U.S. Pat. No. 4,111,088 to Ziegelmeyer sets forth a gauge including a length indicating combination for use with power saws which are movable relative to a stationary work piece wherein an included fence includes sections of various lengths which may be combined end to end to provide a fence of desired length for use dependent upon the length of the work piece and extent of travel of the associated saw.

U.S. Pat. No. 8,827,826 to Martin sets forth a work piece supporting table surface where the table has a plurality of guide rails for securement of a backstop of interest relative to the instant invention, but of an organization lacking the many enhanced structural details for the efficient and effective adjustment of a guide fence relative to a saw blade.

U.S. Pat. No. 3,807,269 to Mertes sets forth a gauge including a fixed gauge block mounting a cam mechanism for locking of an associated rod supporting a steel measuring tape. The block further mounts a pointer alignable with a setting on the tape for adjustment relative to an associated saw blade. The Mertes patent is of interest relative to another approach in use of gauges relative to a saw blade.

U.S. Pat. No. 3,741,068 to Brettauer sets forth a gauge for use in combination with portable electric saws wherein locking means is available to fix the orientation of a bracket associated with a guide relative to an associated saw blade.

As such, it may be appreciated that there is a continuing need for a new and improved sawmill gauge which combines the features of effectiveness, ease of operation, and efficiency of purpose, and as such the instant invention substantially fulfills these needs.

SUMMARY OF THE INVENTION

In view of the foregoing disadvantages inherent in the known types of sawmill gauges now present in the prior art, the present invention provides a new and improved sawmill gauge of efficient and effective contruction for use in combination with a rotary saw. As such, the general purpose of the present invention, which will be described subsequently in greater detail is to provide a new and improved saw mill gauge which has all the advantages of the prior rt saw mill gauges and none of the disadvantages.

To attain this, the present invention comprises a sawmill gauge wherein a reciprocating carriage is threadedly secured to a plurality of spaced rotatable rails longitudinally secured at either of their ends within an elongate framework wherein said rails are further connected by a train drive interconnecting first ends of the spaced rails with an elongate handle extending outwardly of said framework for direct rotation of one of said rails and effecting like rotation of the other said rails for reciprocation of said carriage therealong. A guide rail is longitudinally and angularly adjustable relative to said carriage and provided with a plurality o adjusting and securement means for adjustment of said gauge relative to a saw blade overlying a plurality of rollers for providing conveyance of work pieces relative to said gauge and said saw blade.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection he nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sawmill gauge which has all the advantages of the prior art sawmill gauges and none of the disadvantages.

It is another object of the present invention to provide a new and improved sawmill gauge which may be easily and efficiently manufactured and marketed.

It is a further object of the present invention to provide a new and improved sawmill gauge which is of a durable and reliable construction.

An even further object of the present invention is to provide a new and improved sawmill gauge which is susceptible of a low cost of manufacture with regard to both materials and labor, and which accordingly is then susceptible of low prices of sale to the consuming public, thereby making such sawmill gauge economically available to the buying public.

Still yet another object of the present invention is to provide a new and improved sawmill gauge which provides in the apparatuses and methods of the prior art some of the advantages thereof, while simultaneously overcoming some of the disadvantages normally associated therewith.

Still another object of the present invention is to provide a new and improved sawmill gauge wherein a reciprocating carriage is reciprocatingly positionable along a plurality of spaced threaded rails wherein said rails are cooperatively driven by interconnecting chain drive for effecting like rotation of said rails by rotation of one of said rails through an extending handle arrangement.

Yet another object of the present invention is to provide a new and improved sawmill gauge wherein a gauge is angularly and longitudinally adjustable relative to a carriage means positionable transversely relative to a saw blade for immediate and effective adjustment of said gauge relative to said saw blade.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is an isometric illustration of a carriage longitudinally adjustable relative to elongate framework of the instant invention.

DESCRIPTION OF THE PREFERRED EMBODIMENT

Figure 1:
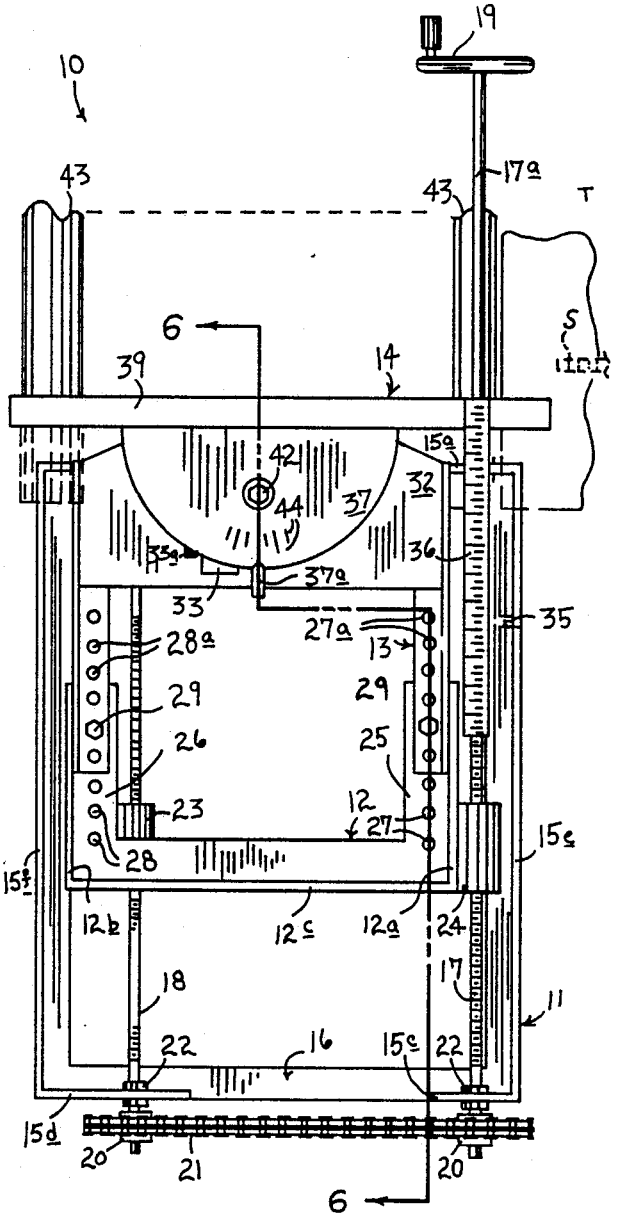
FIG. 1 is a top orthographic view of the instant invention.

With reference now to the drawings, and in particular to FIGS. 1 to 8 thereof, a new and improved sawmill gauge embodying the principles and concepts of the present invention and generally designated by the reference numeral 10 will be described.

With attention to FIG. 1, it will be noted that the sawmill gauge apparatus 10 essentially comprises a support framework 11 reciprocatingly supporting a "U" shaped carriage 12 wherein a gauge support framework 13 is fastened thereon. A gauge assembly 14 for aligning and orienting work pieces to be directed past an associated saw table "T" and a saw blade "S" are directed along an included gauge surface 14 on a conveyor assembly comprising a series of conveyor rollers 43.

Figure 8:
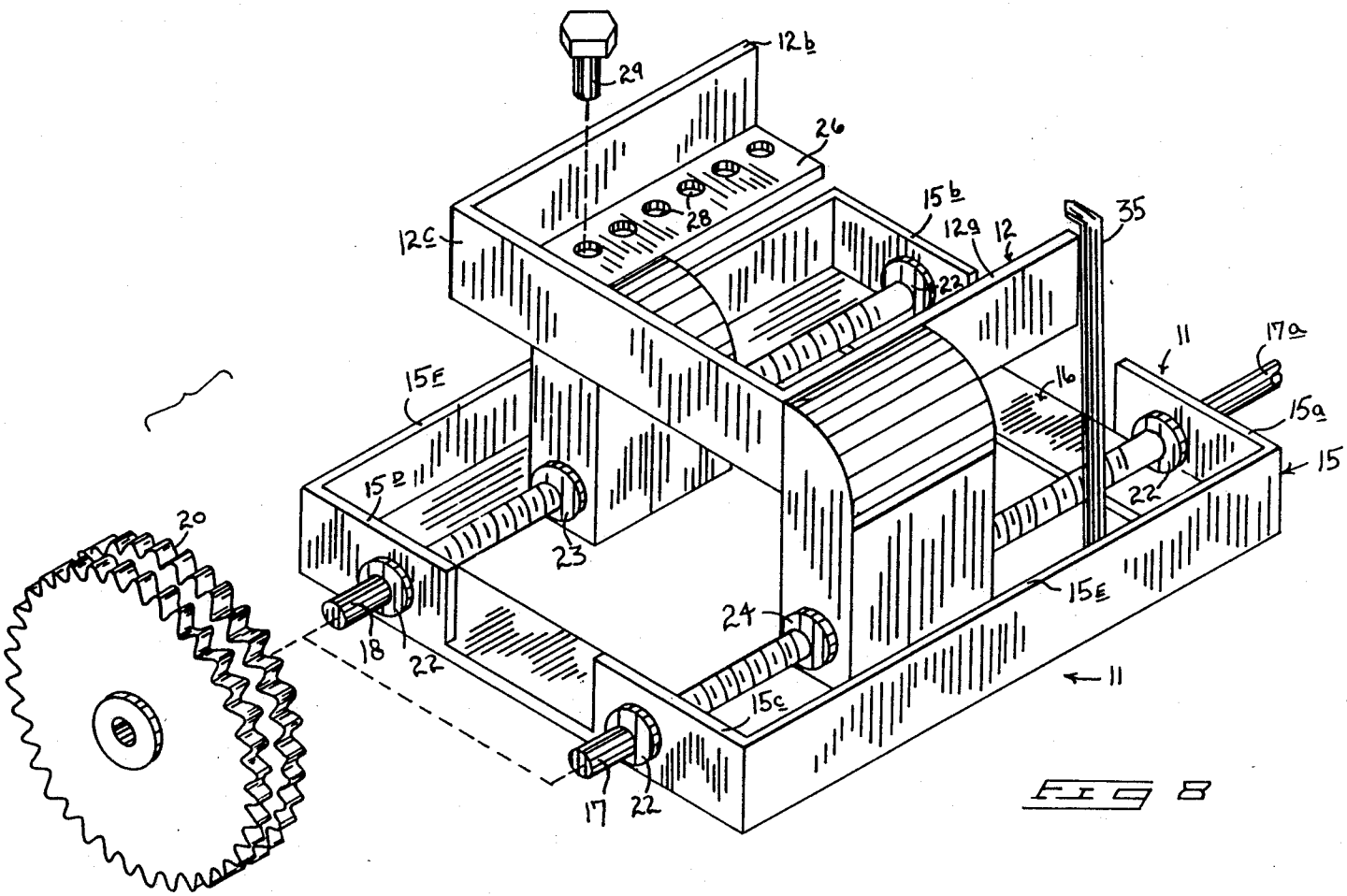
FIG. 8 is a front end orthographic view taken in elevation of the instant invention.

Attention to FIG. 8 illustrates the support framework 11 including a rectangular perimeter vertical flange member 15 comprising a rear right flange portion 15*a*, a rear left flange portion 15*b*, a right forward flange portion 15*c*, a left forward flange portion 15*d*, a right flange portion 15*e*, and a left flange portion 15*f*. An orthogonal inwardly directed floor frame 16 is integrally secured to the flange member 15 to effect a rigid organization for the support framework 11. A first rotatable cylindrical track 17 is secured to the support framework 11 through the rear flange portion 15*a* and the forward flange portion 15*c* through a plurality of bearings 22 maintaining the first rotatable cylindrical track in a fixed relationship relative to the framework 11. An extension shaft 17*a*, as illustrated in FIGS. 1 and 8, extends rearwardly of the framework Il and terminates in a rotatable adjustment wheel 19. A second rotatable cylindrical track 18 is aligned parallel to the first rotatable cylindrical track and secured to the support framework 11 through like bearings 22 and directed through the rear flange portion 15*b* and the forward flange portion 15*d*. A plurality of double-tooth gears 20 are integrally and fixedly at projecting ends of the respective first and second tracks 17 and 18 extending outwardly of the support framework 11, as illustrated in FIGS. 1 and 8 for example. An associated double row chain drive 21 interrelates the respective gears 20 and associated tracks 17 and 18 Upon rotation of the adjustment wheel 19, the "U" shaped carriage 12 may be reciprocated forwardly and rearwardly within the support framework 11. Secured to right flange portion 15*f* is an "L" shaped indicator for cooperation with a steel top 36 secured to gauge bar 39 to indicate longitudinal portioning of the gauge assembly 14 within the framework 11.

The "U" shaped carriage 12 includes a left internally threaded upwardly extending case 23 and a mirror image right internally threaded upwardly extending case 24. In this manner, rotation of the respective track 17 and 18 by wheel 19 accordingly reciprocates the associated carriage 12 within framework 11. A right vertical carriage flange 12*a* is oriented parallel to a mirror image left vertical carriage flange 12*b* with an interconnecting forward carriage flange 12*c* associating the two together. As may be viewed most readily in FIGS. 1 and 8, the right case 24 is integrally secured to an exterior surface of the inwardly directed right vertical flange 12*a* with the left case 23 integrally secured to an interior edge of the left carriage plate 26 to offset the "U" shaped carriage 12 to the left of the support framework I!, as illustrated in FIG. 1. This offset relationship will be discussed below, but the essential purpose is to provide positioning of the steel tape 36 secured to the gauge assembly 14. The left carriage plate 26 has formed therethrough a series of left carriage apertures 28 and accordingly the right carriage plate 25 has formed therethrough a plural aligned series of right carriage apertures 27. In conjunction with connectors 29, the gauge support framework 13 is accordingly secured to the carriage 12 in an overlying relationship thereto.

Figure 5:
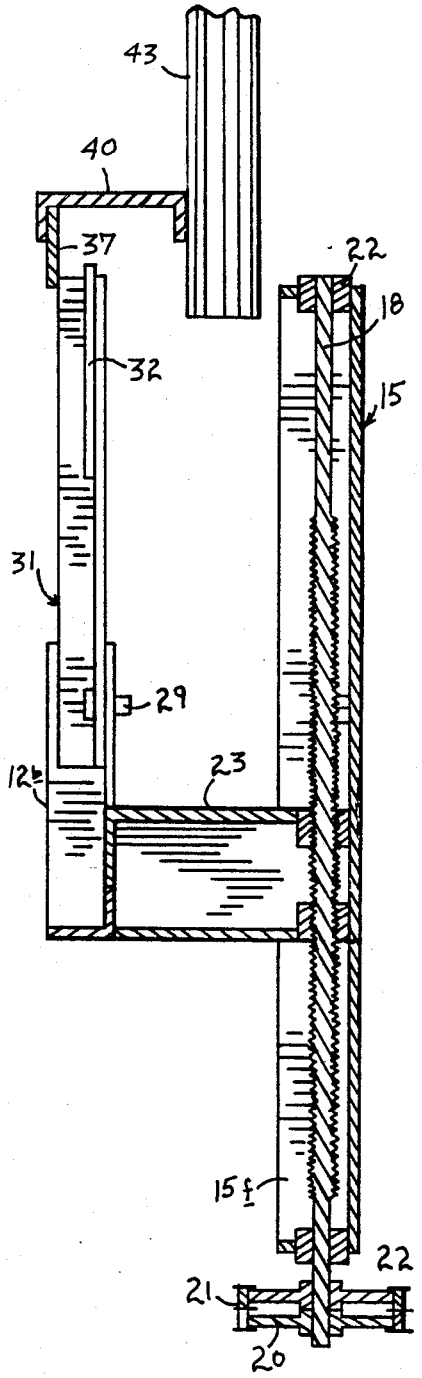
FIG. 5 is an orthographic view taken along the lines 5—5 of FIG. 3 in the direction indicated by the arrows.
Figure 6:
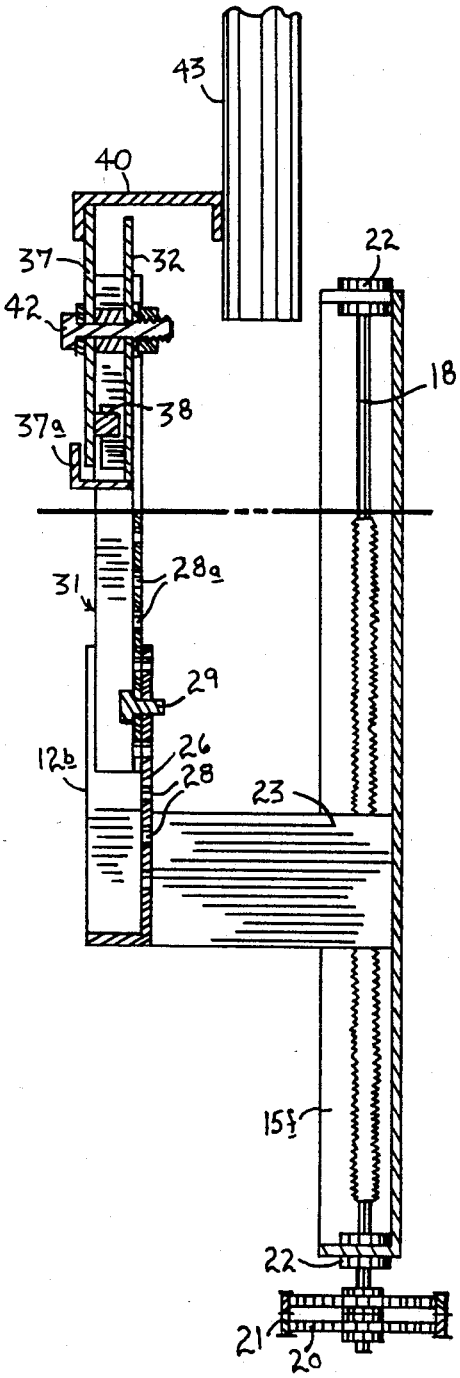
FIG. 6 is an orthographic view taken along the lines 6—6 of FIG. 1 in the direction indicated by the arrows.
Figure 7:
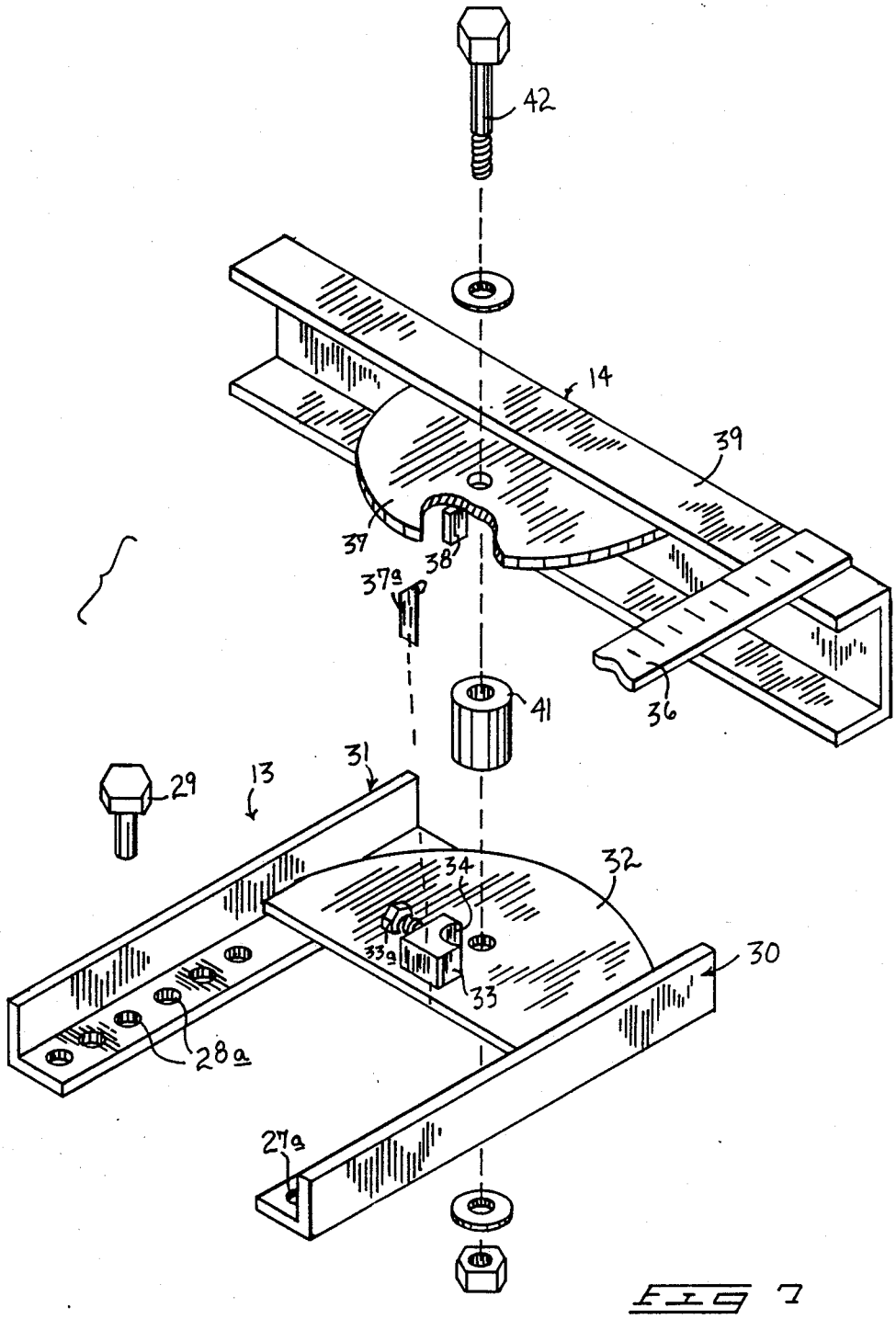
FIG. 7 is an isometric exploded illustration of the guide bar and supportive framework for securement to a carriage associated with the instant invention.

The gauge support framework 18 illustrated in FIGS. 1 and 7 for example, comprises an elongate right "L" shaped bracket 30 and a mirror image left elongate "L" shaped bracket 81 formed with right gauge apertures 27*a* and respective gauge apertures 28*a* to enable the aforenoted securement to the carriage 12 by means of the connectors 29, as may be illustrated in FIG. 1, 5, and 6 for example. A spanner flange 32 integrally joined and maintains in parallel alignment the aforenoted right and left "L" shaped support brackets 30 and 31 whereupon an adjustment block 33 has orthogonally aligned therethrough an adjustment bolt 33*a* positioned within a through threaded bore (not shown) within the adjustment block 33. The adjustment block 33 is formed with an arcuate interface 34 to enable rotation of an associated adjustment tab 88 orthogonally depending downwardly from the indicator gauge plate 37 integrally formed to the gauge assembly 14, as illustrated in FIG. 6 add 7.

Figure 2:
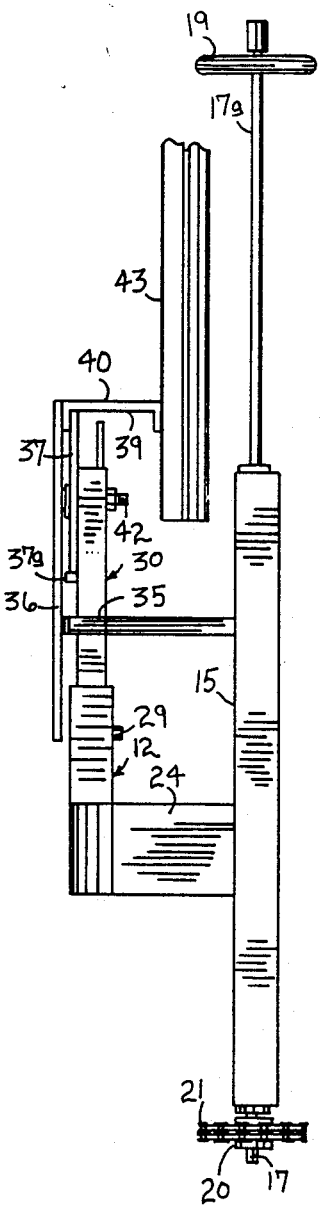
FIG. 2 is a side orthographic view taken in elevation of the instant invention.
Figure 3:
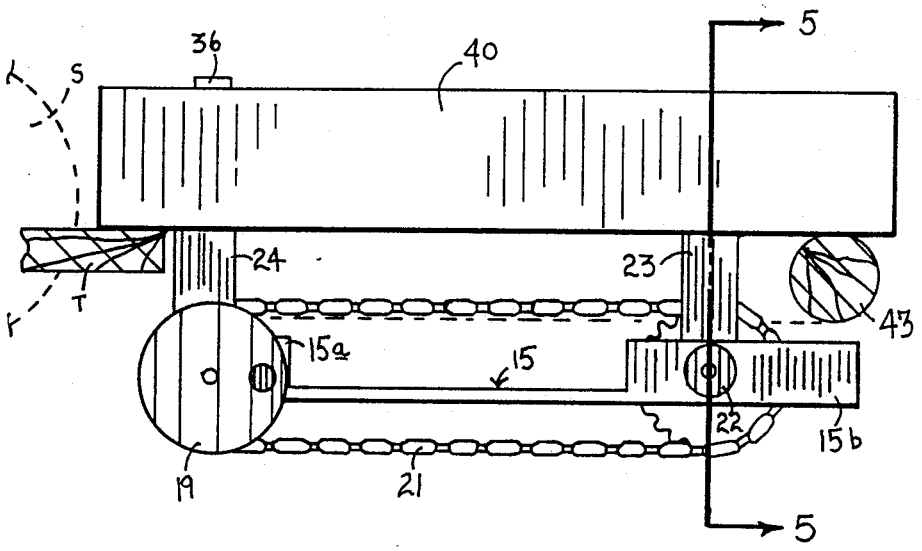
Figure 4:
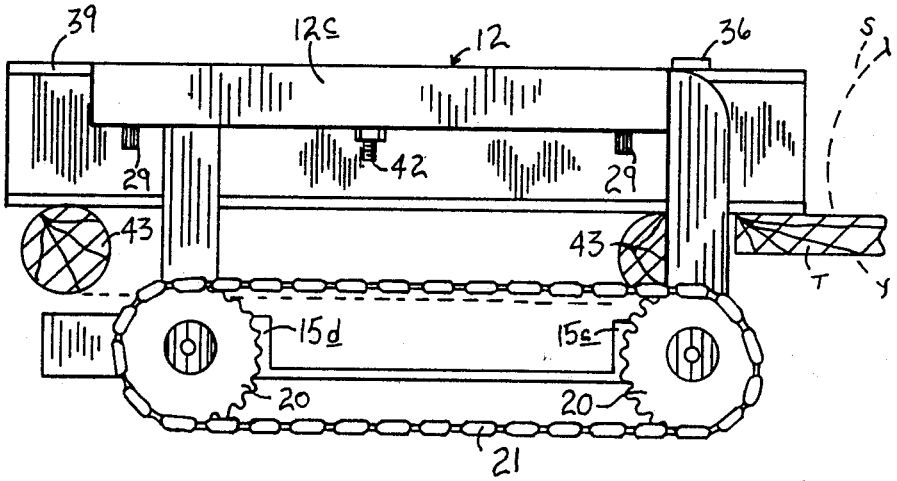
FIG. 4 is a rear end orthographic view taken in elevation of the instant invention.

The gauge assembly 14 includes the gauge bar 39 with a gauge surface 40, as illustrated in FIGS. 2, , 5, add 6 to broaden a surface orienting work pieces directed over the illustrated conveyor rollers 48 and direct such work pieces to the saw "S", as illustrated in FIG. 1 for example. A steel tape 86 is integrally and orthogonally secured relative to the gauge surface 40 parallel to the direction of travel of the "U" shaped carriage and associated gauge assembly 14 to indicate the longitudinal positioning of the gauge surface 40 relative to the saw "S". An indicator gauge plate 37 formed as a semi-circular plate directed towards the "U" shaped carriage and formed with indicator indicia 44 that in cooperation with a plate pointer 37*a* integrally secured depending upwardly from the spanner flange 82 indicates relative arcuate rotation of the gauge assembly 14 and associated gauge bar 89. A spacer 41 positioned between the indicator gauge plate 37 and the underlying spanner flange 82 spaces the gauge plate 87 to enable acceptance of the adjustment block 33 to operate freely therebetween. A connector 42 thereafter may secure the gauge assembly 14 to the gauge support framework 13 by a complement of conventional fasteners, as illustrated in FIG. 7.

It may be appreciated that upon loosening of the connector 42, the adjustment bolt 33*a* may be manipulated to provide directed force to a confronting surface of the adjustment tab 88 and effect counter-clockwise fine adjustment of the gauge surface 39 and associated gauge surface 40.

As to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is Claimed as Being New and Desired to be Protected by Letters Patent of the U.S. is as Follows:

1. A sawmill gauge for use in cooperation with a fixed saw comprising, a support framework means for fixed positioning to a support surface;

said framework means including an elongate perimeter frame including rotatable track means therewithin for reciprocating a carriage parallel to said frame and operatably secured to said track means;

said carriage adjustably receiving a gauge support framework;

said gauge support framework including a plurality of brackets longitudinally adjustable relative to said carriage and formed with a transverse spanner flange means for rotatably receiving a gauge assembly;

said gauge assembly including a gauge bar formed with a planar gauge surface, and said gauge surface orthogonally oriented overlying a conveyor means for directing elongate work pieces to said saw, and wherein said rotatable track means include a first cylindrical track parallel to and spaced from a second cylindrical track;

said first and second cylindrical tracks externally threaded for cooperation with internal threads formed in said carriage for reciprocating said carriage, and first and second ends of said first and second cylindrical tracks extending outwardly of said frame and each having fixed thereon a gear wherein each gear communicates with the other gear for effecting simultaneous and like rotation of said first and second tracks, and an extension shaft extending outwardly of said frame opposed to said gear fixed to said first track wherein said extension shaft has formed thereon a rotatable adjustment wheel means for rotation of said first track and simultaneous rotation of said second track in a same direction of rotation.

2. A sawmill gauge as set forth in claim 1 wherein an "L" shaped indicator is secured to a longitudinal portion of said support framework extending upwardly and cooperating with an elongate measuring tape fixedly secured to said gauge bar for indication of longitudinal positioning of said gauge bar relative to said support framework.

3. A sawmill gauge as set forth in claim 2 wherein said carriage includes first upwardly extending internally threaded case cooperating with said second rotatable track and a second upwardly extending case internally threaded to cooperate with said first track wherein a "U" shaped frame including a plurality of legs is secured integrally to said first and second upwardly extending case wherein said "U" shaped frame is offset relative to said first and second upwardly extending case to accommodate said steel tape longitudinally of said "U" shaped frame wherein said steel tape is in overlying relationship to said first rotatable track.

4. A sawmill gauge as set forth in claim 3 wherein said plurality of legs of said "U" shaped framework accepts said plurality of legs of said gauge support framework adjustably therealong.

5. A sawmill gauge as set forth in claim 4 wherein said plurality of legs of said gauge support framework and said plurality of legs of said "U" shaped frame are each formed with through extending apertures for adjustable securement of said gauge support framework to said "U" shaped frame.

6. A sawmill gauge as set forth in claim 5 wherein said gauge support framework includes an adjustment block integrally secured to said spanner flange means wherein said adjustment block is formed with a threaded aperture orthogonal to said plurality of legs of said gauge support framework with an adjustment bolt rotatably adjustable therethrough for cooperation with an adjustment tab orthogonally secured to an overlying indicator plate overlying said spanner flange means to enable said adjustment bolt to cooperate with said adjustment tab for rotating said gauge plate relative to said spanner flange meansand said frame.

7. A sawmill gauge as set forth in claim 6 wherein said indicator gauge plate is orthogonally secured to said gauge bar.

8. A sawmill gauge as set forth in claim 7 wherein said conveyor means comprises a series of rollers.

9. A sawmill gauge as set forth in claim 8 wherein said gauge plate is formed with a series of indicator indicia cooperating with an indicator integrally secured to said spanner flange.

* * * * *